US010558232B2

(12) United States Patent
Ide et al.

(10) Patent No.: US 10,558,232 B2
(45) Date of Patent: Feb. 11, 2020

(54) REGULATOR CIRCUIT AND CONTROL METHOD

(71) Applicant: SONY CORPORATION, Tokyo (JP)

(72) Inventors: Daisuke Ide, Fukuoka (JP); Toshio Suzuki, Fukuoka (JP); Nobuhiko Shigyo, Fukuoka (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/574,381

(22) PCT Filed: May 12, 2016

(86) PCT No.: PCT/JP2016/064082
§ 371 (c)(1),
(2) Date: Nov. 15, 2017

(87) PCT Pub. No.: WO2016/190112
PCT Pub. Date: Dec. 1, 2016

(65) Prior Publication Data

US 2018/0136679 A1 May 17, 2018

(30) Foreign Application Priority Data

May 26, 2015 (JP) ..... 2015-106418

(51) Int. Cl.
*G05F 1/575* (2006.01)
*G05F 5/00* (2006.01)

(52) U.S. Cl.
CPC ..... *G05F 1/575* (2013.01); *G05F 5/00* (2013.01)

(58) Field of Classification Search
CPC . G05F 1/56; G05F 1/575; G05F 1/465; G05F 1/468; G05F 1/562; G05F 1/565;
(Continued)

(56) References Cited

U.S. PATENT DOCUMENTS 5,747,974 A * 5/1998 Jeon ..... G05F 1/465 323/269
6,977,490 B1 * 12/2005 Zhang ..... G05F 1/575 323/280
(Continued)

FOREIGN PATENT DOCUMENTS

CN 101183270 A 5/2008
JP 2004-005670 A 1/2004
(Continued)

OTHER PUBLICATIONS

International Search Report and Written Opinion of PCT Application No. PCT/JP2016/064082, dated Jul. 26, 2016, 06 pages of ISRWO.

*Primary Examiner* — Nguyen Tran
(74) *Attorney, Agent, or Firm* — Chip Law Group

(57) ABSTRACT

The present technology relates to a regulator circuit and a control method capable of coping with steep change in load. An output transistor provided between an input terminal and an output terminal, a differential amplifying unit that amplifies a difference between reference voltage and voltage fed back from the output transistor, a voltage feedback path, and a current feedback path are provided, in which the current feedback path includes a current source and a transistor. The transistor included in the current feedback path is formed of an NMOS, a gate is connected to an output terminal of the differential amplifying unit, a drain is connected to the current source, and a source is connected to an input terminal of the differential amplifying unit. The present technology is applicable to a regulator circuit.

11 Claims, 12 Drawing Sheets

(58) Field of Classification Search
CPC ..... G05F 1/569; G05F 1/571; G05F 1/573; G05F 1/5735
USPC ..... 323/269, 273–281
See application file for complete search history.

(56) References Cited

U.S. PATENT DOCUMENTS

| | | | | |
|---|---|---|---|---|
| 7,301,315 | B2 * | 11/2007 | Noda | G05F 3/242 323/280 |
| 8,294,441 | B2 * | 10/2012 | Gurcan | G05F 1/575 323/280 |
| 8,716,993 | B2 * | 5/2014 | Kadanka | G05F 1/56 323/274 |
| 2009/0128107 | A1 | 5/2009 | Wang et al. | |
| 2010/0052635 | A1 * | 3/2010 | Wang | G05F 1/575 323/280 |
| 2014/0354249 | A1 | 12/2014 | Kurozo et al. | |
| 2015/0277458 | A1 * | 10/2015 | Suzuki | G05F 1/56 323/280 |

FOREIGN PATENT DOCUMENTS

| | | | |
|---|---|---|---|
| JP | 2006-065836 | A | 3/2006 |
| JP | 2010-079653 | A | 4/2010 |
| JP | 2013-089188 | A | 5/2013 |
| JP | 2015-007958 | A | 1/2015 |

* cited by examiner

REGULATOR CIRCUIT AND CONTROL METHOD

CROSS REFERENCE TO RELATED APPLICATIONS

This application is a U.S. National Phase of International Patent Application No. PCT/JP2016/064082 filed on May 12, 2016, which claims priority benefit of Japanese Patent Application No. JP 2015-106418 filed in the Japan Patent Office on May 26, 2015. Each of the above-referenced applications is hereby incorporated herein by reference in its entirety.

TECHNICAL FIELD

The present technology relates to a regulator circuit and a control method. In detail, this relates to a regulator circuit and a control method for stabilizing input voltage to output.

BACKGROUND ART

In order to stably operate an electronic circuit, there is a case where it is desired to stabilize power supply voltage to a certain value. Also, the power supply voltage required by each electronic circuit is not necessarily prepared in a device on which the electronic circuit is mounted. In such a case, in order to easily and stably generate the power supply voltage required by the electronic circuit, a regulator circuit is widely used.

The regulator circuit is generally provided with a differential amplifier, an output transistor, and a feedback resistor. The differential amplifier compares output voltage fed back by a feedback resistor with desired reference voltage and controls voltage of a control terminal of the output transistor such that the two voltages approach each other. Therefore, in a case where input voltage or a load fluctuates, the voltage of the control terminal of the output transistor must be changed according to the fluctuation. Patent Documents 1 to 3 disclose techniques of coping with such fluctuation in input voltage and load.

CITATION LIST

Patent Document

Patent Document 1: Japanese Patent Application Laid-Open No. 2010-079653

Patent Document 2: Japanese Patent Application Laid-Open No. 2006-065836

Patent Document 3: Japanese Patent Application Laid-Open No. 2004-005670

SUMMARY OF THE INVENTION

Problems to be Solved by the Invention

According to the techniques of coping with the fluctuation in input voltage and load disclosed in Patent Documents 1 to 3, there is a case where it is impossible to respond to steep fluctuation because it is not possible to cope with the same only after gate voltage of the output transistor fluctuates. Also, according to Patent Document 3, since a feedback signal is received by a source and a source, two or more transistors are necessarily required for a control path, and a circuit configuration becomes complicated.

It is desired that stable voltage may be supplied also for the steep fluctuation in input voltage and load without a complicated circuit configuration.

The present technology is achieved in view of such a situation, and an object thereof is to supply stable voltage for steep fluctuation in load.

Solutions to Problems

A regulator circuit according to one aspect of the present technology is provided with an output transistor provided between an input terminal and an output terminal, a differential amplifying unit that amplifies a difference between reference voltage and voltage fed back from the output transistor, a voltage feedback path, and a current feedback path, in which the current feedback path includes a current source and a transistor.

A control terminal of the transistor included in the current feedback path may be connected to an output terminal from the differential amplifying unit.

The transistor included in the current feedback path may be formed of an NMOS, a gate may be connected to an output terminal of the differential amplifying unit, a drain may be connected to the current source, and a source may be connected to an input terminal of the differential amplifying unit.

A buffer with an output terminal connected to a control terminal of the output transistor may further be included.

A buffer with an output terminal connected to a control terminal of the output transistor, and a transistor for feeding back current proportional to load current to bias current of the buffer may further be included.

The output transistor may be an NMOS.

An inverting buffer with an output terminal connected to a control terminal of the output transistor may further be provided.

An inverting buffer with an output terminal connected to a control terminal of the output transistor, and a transistor for feeding back current proportional to load current to bias current of the inverting buffer may further be provided.

A replica circuit may further be provided on the voltage feedback path.

The replica circuit may include first to third transistors, a control terminal of the first transistor may be connected to an output terminal of the differential amplifying unit, and the second transistor and the third transistor may serve as the current source.

A plurality of output stages may be provided for one differential amplifying unit, and each of the output stages may include a current feedback path, an output transistor, and a feedback resistor.

A control method according to one aspect of the present technology is a control method of a regulator circuit provided with an output transistor provided between an input terminal and an output terminal, and a differential amplifying unit that amplifies a difference between reference voltage and voltage fed back from the output transistor, the control method including steps of controlling voltage feedback by a voltage feedback path, and controlling current feedback by a current feedback path, in which the current feedback is performed by controlling a current source and a transistor included in the current feedback path.

In a regulator circuit and a control method according to one aspect of the present technology, an output transistor is provided between an input terminal and an output terminal, and a differential amplifying unit that amplifies a difference between reference voltage and voltage fed back from the output transistor is provided. There also are a voltage feedback path and a current feedback path, and the current feedback path includes a current source and a transistor.

Effects of the Invention

According to one aspect of the present technology, it is possible to supply stable voltage for steep fluctuation in load.

Meanwhile, the effects are not necessarily limited to the effects herein described and may include any of the effects described in the present disclosure.

MODE FOR CARRYING OUT THE INVENTION

A mode for carrying out the present technology (hereinafter, referred to as an embodiment) is hereinafter described. Meanwhile, the description is given in the following order.

1. Configuration of Regulator (Conventional)
2. Configuration of Regulator (First Embodiment)
3. Second Embodiment
4. Third Embodiment
5. Fourth Embodiment
6. Fifth Embodiment
7. Sixth Embodiment

Configuration of Regulator (Conventional)

The present technology hereinafter described is applicable to a regulator circuit that stabilizes voltage to supply. Herein, a case where the present technology is applied to the regulator circuit is described as an example.

In order to make a difference between the regulator circuit to which the present technology is applied and a conventional regulator circuit clear, the conventional regulator circuit is described with reference to FIGS. 1 to 3, and the regulator to which the present technology is applied is described with reference to FIG. 4 and subsequent drawings.

Figure 1:
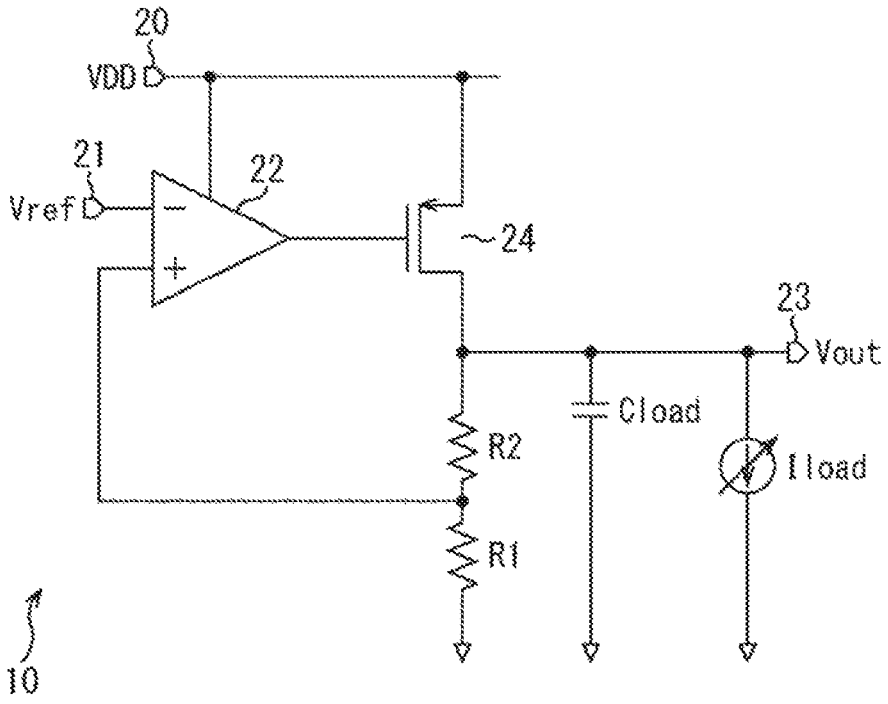
FIG. 1 is a view illustrating an example of a configuration of a regulator.

FIG. 1 is a view illustrating a configuration of an example of the regulator circuit. Input voltage VDD supplied through an input terminal 20 of a regulator circuit 10 is supplied to a source side of a PMOS transistor 24 and a differential amplifier 22.

Output voltage is supplied from a drain side of the transistor 24 to a load through an output terminal 23 and divided voltage by resistors R1 and R2 is supplied to a non-inverting input terminal of the differential amplifier 22. At that time, an inverting input terminal and the non-inverting input terminal of the differential amplifier 22 operate so as to have the same potential.

In the regulator circuit 10 illustrated in FIG. 1, reference voltage (Vref) and voltage generated by a feedback resistor are fed back to the differential amplifier 22, the differential amplifier 22 compares the voltages with each other, and gate voltage of the output transistor 24 is controlled such that the voltages approach each other, so that it is controlled such that the output voltage is stabilized.

The configuration of the regulator circuit 10 is required to respond at a high speed to steep fluctuation in load current, but since a feedback path from the feedback resistor feeds back to a high impedance node, a response speed is low. In order to increase the response speed, it is proposed to provide a new feedback path. For example, as illustrated in FIG. 2, a method of realizing the high-speed response by providing a transistor 31 for feeding back current proportional to the load current to the differential amplifier 22 as bias current is proposed.

Figure 2:
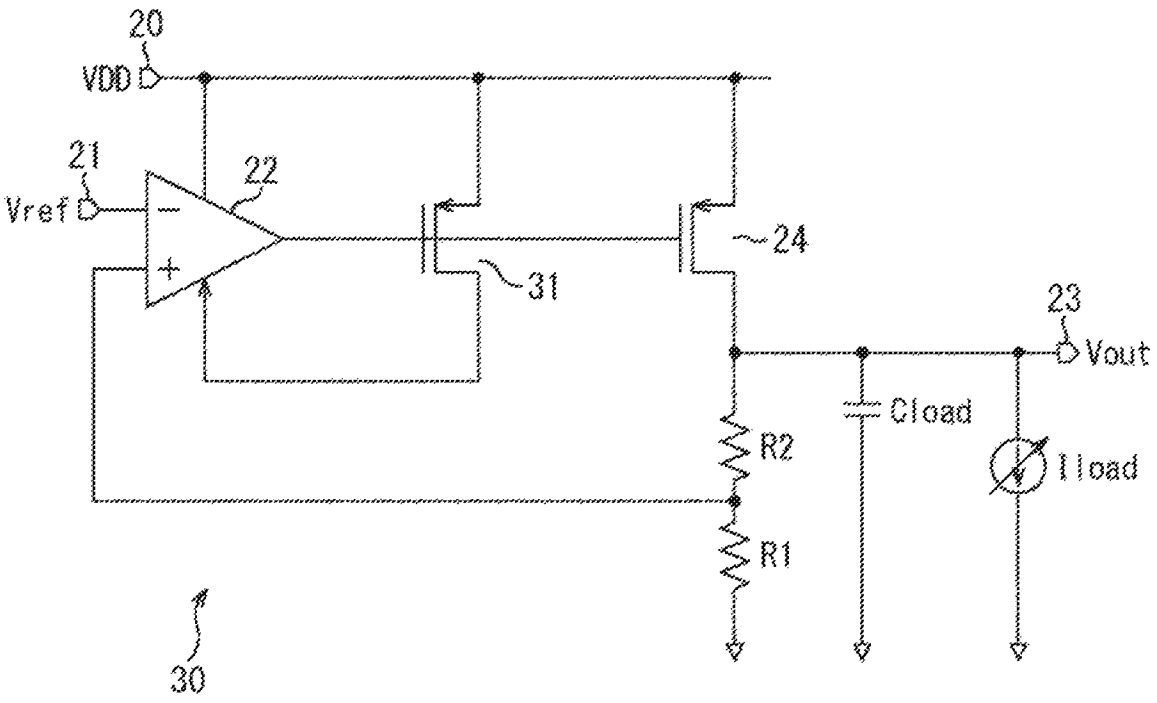
FIG. 2 is a view illustrating an example of the configuration of the regulator.

According to a regulator circuit 30 illustrated in FIG. 2, there is an effect on the fluctuation in the load current only after gate voltage of the transistor 31 (PMOS transistor) fluctuates. That is, although there is an effect of helping the response of the feedback path from the feedback resistor, a high-speed feedback path cannot be realized.

A gain (input/output characteristic) of a circuit that applies feedback with voltage such as the regulator circuit 10 illustrated in FIG. 1 and the regulator circuit 30 illustrated in FIG. 2 is described. For the purpose of description, it is assumed that the regulator circuit is a simplified voltage feedback amplifier as illustrated in FIG. 3.

Figure 3:
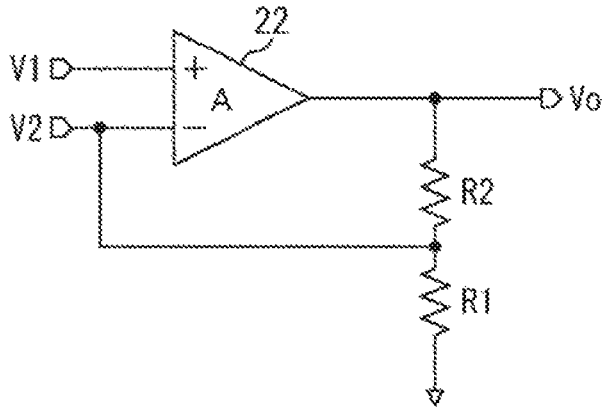
FIG. 3 is a view illustrating a simplified configuration of the regulator.

In the voltage feedback amplifier illustrated in FIG. 3, V1 represents input voltage, V2 represents feedback voltage, and V0 represents output voltage. Also, the gain of the differential amplifier 22 is represented by A. In such a case, a relationship among the output voltage V0, the input voltage V1, and the voltage V2 satisfies following expression (1), and the voltage V2 satisfies following expression (2).

[Mathematical Expression 1]

$$V0 = A \cdot (V1 - V2) \tag{1}$$

$$V2 = \frac{R1}{R1 + R2} V0 \tag{2}$$

From the expressions (1) and (2), the output voltage V0 may be expressed by following expression (3).

[Mathematical Expression 2]

$$V0 = A \cdot \left(V1 - \frac{R1}{R1 + R2} V0\right) \tag{3}$$

From expression (3), the gain (V0/V1) of the voltage feedback amplifier may be derived as expressed in following expression (4).

[Mathematical Expression 3]

$$\frac{V0}{V1} = \frac{\frac{R1 + R2}{R1}}{1 + \frac{R1 + R2}{A \cdot R1}} \tag{4}$$

From expression (4), it is understood that the gain of the voltage feedback amplifier may be set by the feedback resistors R1 and R2.

In this manner, in a case of the voltage feedback amplifier, there is a method of monitoring the gate voltage of the output transistor and applying the feedback in order to respond to the steep fluctuation in load current at a high speed; however, in this method, there is an effect only after the gate voltage of the output transistor fluctuates. Therefore, there is a possibility that high-speed response to the steep fluctuation cannot be realized.

Since the voltage gain A of the differential amplifier 22 is a finite value and has a frequency characteristic, if gain setting (feedback resistors R1 and R2) is changed, the frequency characteristic of the voltage feedback amplifier might be changed.

Also, in the voltage feedback amplifier, the frequency characteristic might differ when the gain setting is changed. Therefore, the regulator circuit to which the present technology is applied capable of responding to the steep fluctuation at a high speed in which the frequency characteristic does not differ even if the gain setting is changed is hereinafter described.

Configuration of Regulator (First Embodiment)

Figure 4:
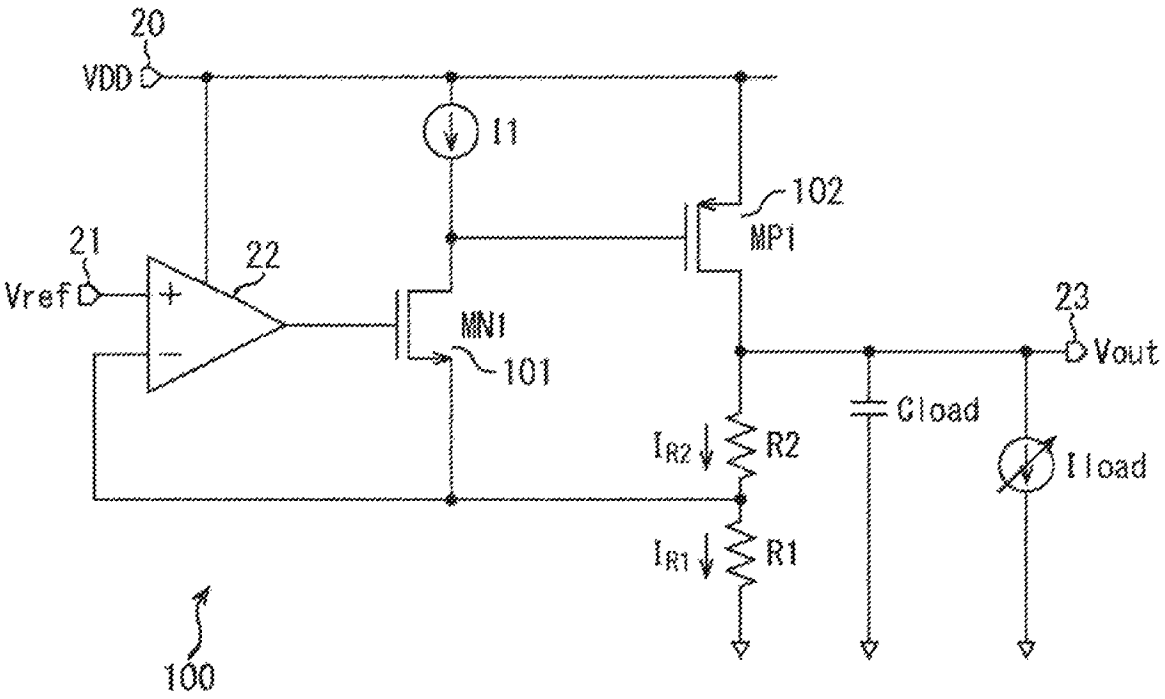
FIG. 4 is a view illustrating a configuration of one embodiment of a regulator to which the present technology is applied.

FIG. 4 is a view illustrating a configuration of one embodiment of a regulator circuit to which the present technology is applied.

A regulator circuit 100 illustrated in FIG. 4 has a configuration obtained by adding a transistor 101 and a current source I1 to the regulator circuit 10 illustrated in FIG. 1. In the regulator circuit 100 illustrated in FIG. 4, the same reference sign is assigned to the same part as that of the regulator circuit 10 illustrated in FIG. 1 and the description thereof is omitted as appropriate.

The transistor 101 of the regulator circuit 100 illustrated in FIG. 4 is an NMOS, a gate (control terminal) thereof is connected to an output terminal of the differential amplifier 22, a drain thereof is connected to the current source I1 connected to the input voltage VDD from the input terminal 20, and a source thereof is connected to the inverting input terminal of the differential amplifier 22.

An output transistor 102 formed of a PMOS of the regulator circuit 100 corresponds to the transistor 24 of the regulator circuit 10 in FIG. 1; a gate thereof is connected to the current source I1 and the drain side of the transistor 101.

Figure 5:
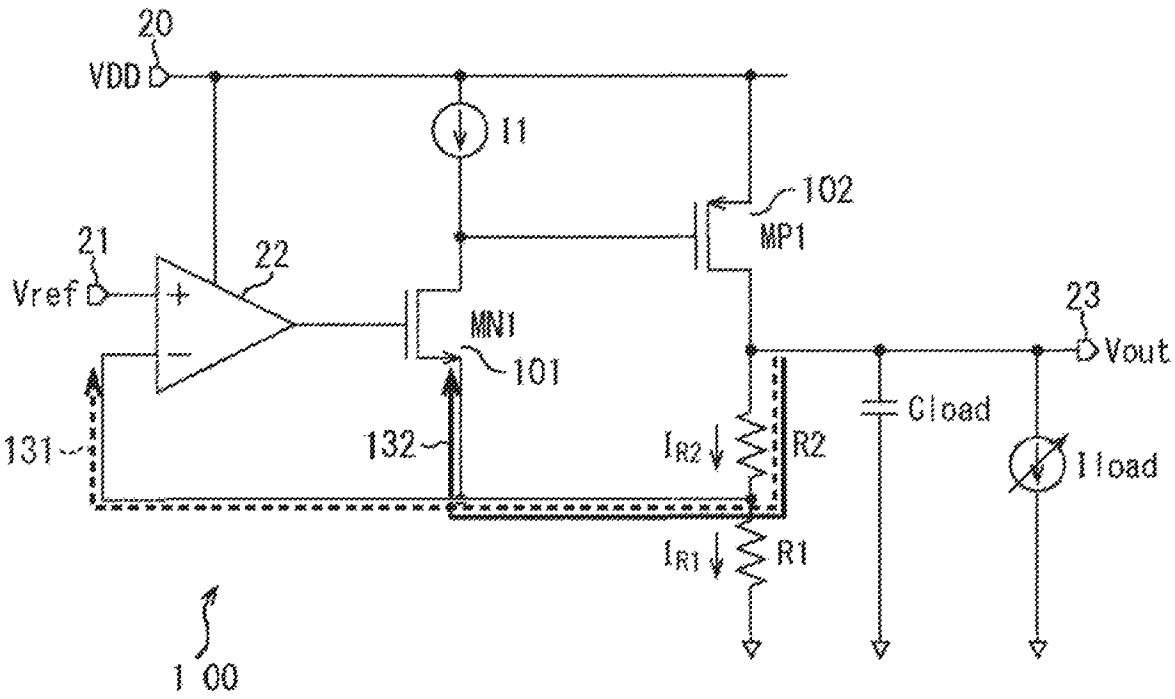
FIG. 5 is a view for illustrating voltage feedback and current feedback.

The regulator circuit 100 is characterized in including not only a voltage feedback path but also a current feedback path as illustrated in FIG. 5. In FIG. 5, the voltage feedback path and the current feedback path are indicated by arrows and are represented as a voltage feedback path 131 and a current feedback path 132, respectively.

In the regulator circuit 100 illustrated in FIG. 4 (FIG. 5), output voltage Vout is expressed by following expression (5).

$$V\text{out} = V\text{ref} + R2(I_{R1} - I_1) \tag{5}$$

In expression (5), Vref represents reference voltage input to the differential amplifier 22, R2 represents a resistance value of the resistor R2, $I_{R1}$ is current flowing through the resistor R1, and $I_1$ is current from the current source I1.

From expression (5) it is understood that the output voltage may be controlled by the current. That is, since a newly added current feedback path 132 becomes a main control loop, a current feedback regulator circuit is obtained. The voltage feedback path 131 which is originally present serves to decrease DC offset voltage of the output voltage in order to increase NMOS gate bias voltage generation of the transistor 101 and a loop gain.

In the regulator circuit 100 illustrated in FIG. 5, the current feedback path 132 serves as a gate grounding circuit with small phase shift, so that it becomes possible to respond at a higher speed than the regulator circuit 10 illustrated in FIG. 1, for example.

Meanwhile, the resistor R1 of the regulator circuit 100 illustrated in FIG. 5 may be replaced with the current source.

Figure 6:
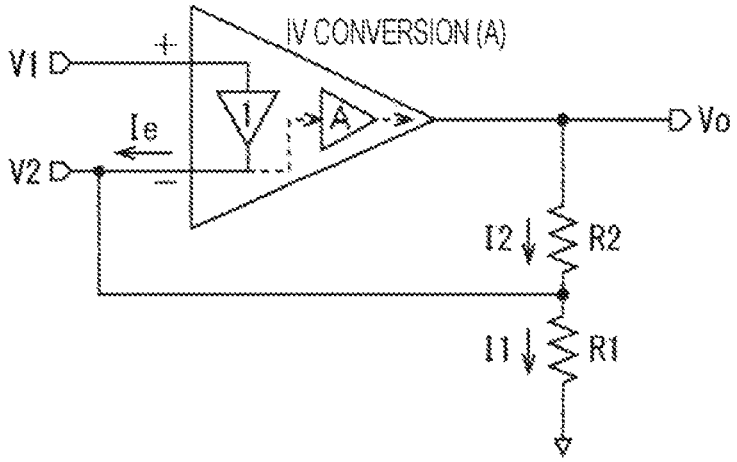
FIG. 6 is a view illustrating a simplified configuration of the regulator.

The gain (input/output characteristic) of the regulator circuit 100 including the voltage feedback path and the current feedback path like the regulator circuit 100 illustrated in FIG. 4 (FIG. 5) is described. For the purpose of description, it is assumed that the regulator circuit 100 is a simplified regulator circuit as illustrated in FIG. 6.

In the regulator circuit illustrated in FIG. 6, V1 represents the reference voltage, V2 represents the feedback voltage, and V0 represents the output voltage in the following expression. Also, a IV conversion gain is represented as IV conversion gain A. Also, I1 represents the current flowing through the resistor R1 and 12 represents the current flowing through the resistor R2. Ie represents the current output from a buffer (gain=1).

A relationship among the current Ie, the current I1, and the current I2 is expressed by following expression (6), and a relationship among the output voltage V0, the input voltage V1, and the voltage V2 is expressed by following expression (7).

$$Ie = I1 - I2 \tag{6}$$

$$V0 = A \cdot Ie = A \cdot (I1 - I2) \tag{7}$$

Since the voltage V1 input to the non-inverting input terminal is output through the buffer (gain=1), voltage V1=voltage V2 is satisfied. From this relationship, the current I1 and the current I2 may be expressed by following expressions (8) and (9), respectively.

[Mathematical Expression 4]

$$I1 = \frac{V1}{R1} \tag{8}$$

$$I2 = \frac{V0 - V1}{R2} \tag{9}$$

From expressions (7), (8) and (9), the gain (V0/V1) of the regulator circuit 100 is expressed by following expression (10).

[Mathematical Expression 5]

$$\frac{V0}{V1} = \frac{\frac{R1 + R2}{R1}}{1 + \frac{R2}{A}} \tag{10}$$

From expression (10), it is understood that the IV conversion gain A relates to the resistor R2 but not to the resistor R1. As a result, it becomes possible to operate without changing the frequency characteristic by the gain setting, by fixing the feedback resistor R2 and changing the feedback resistor R1 to use.

Second Embodiment

Figure 7:
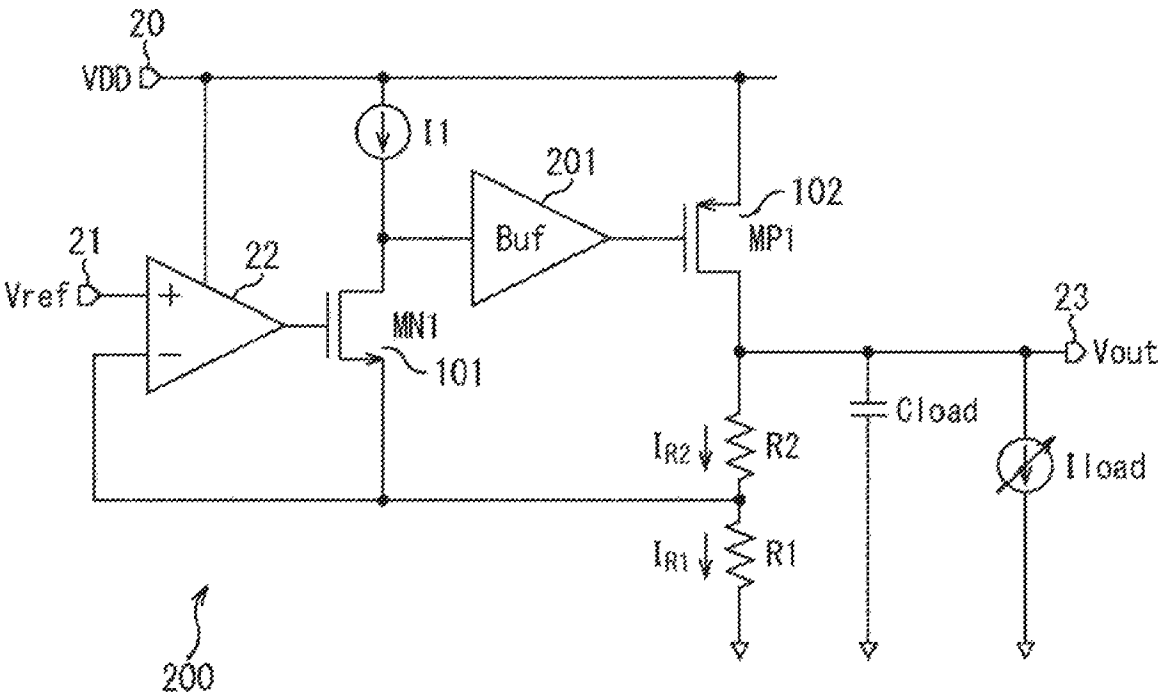
FIG. 7 is a view illustrating another configuration of one embodiment of the regulator to which the present technology is applied.

A second embodiment of a regulator circuit is described. FIG. 7 is a view illustrating a configuration of a regulator circuit 200 according to the second embodiment.

The regulator circuit 200 illustrated in FIG. 7 has a configuration obtained by adding a buffer 201 to the regulator circuit 100 illustrated in FIG. 4. An output terminal of the buffer 201 is connected to a gate side of an output transistor 102 and an input terminal thereof is connected to a current source I1.

The regulator circuit sometimes supplies voltage to a circuit with large load current. In such a case, a size of the output transistor 102 increases and there is large parasitic capacitance. Therefore, by adding the buffer 201, it becomes possible to easily drive the large parasitic capacitance, thereby obtaining an effective configuration even in a case where the size of the output transistor 102 increases.

Third Embodiment

Figure 8:
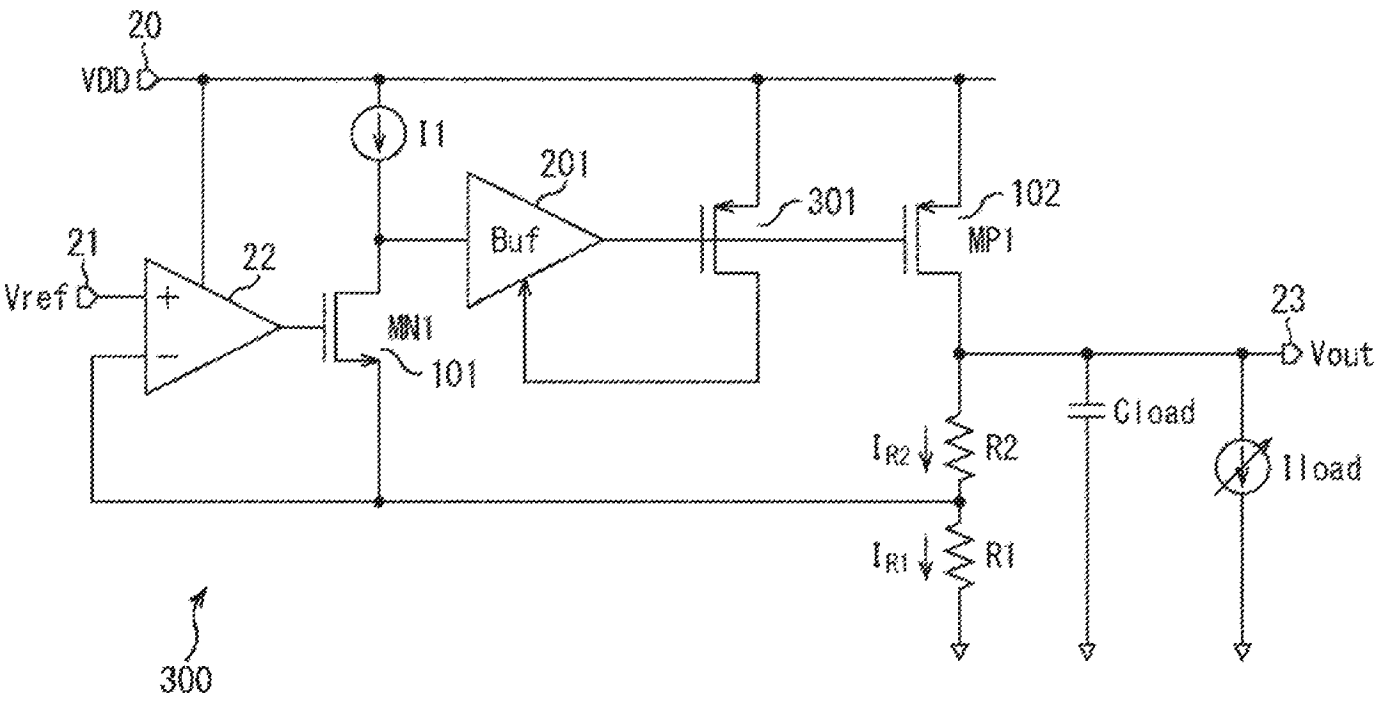
FIG. 8 is a view illustrating another configuration of one embodiment of the regulator to which the present technology is applied.

A third embodiment of a regulator circuit is described. FIG. 8 is a view illustrating a configuration of a regulator circuit 300 in the third embodiment.

The regulator circuit 300 illustrated in FIG. 8 has a configuration obtained by adding a PMOS transistor 301 to the regulator circuit 200 illustrated in FIG. 7. A gate of the transistor 301 is connected to an output terminal of a buffer 201, a source thereof is connected to input voltage VDD, and a drain thereof is connected to the buffer 201.

The configuration of the regulator circuit 300 illustrated in FIG. 8 is such that current proportional to load current is added to bias current of the buffer 201. By feeding back the current proportional to the load current, it is possible to configure to realize a higher speed than that of the regulator circuit 200 illustrated in FIG. 7.

Fourth Embodiment

Figure 9:
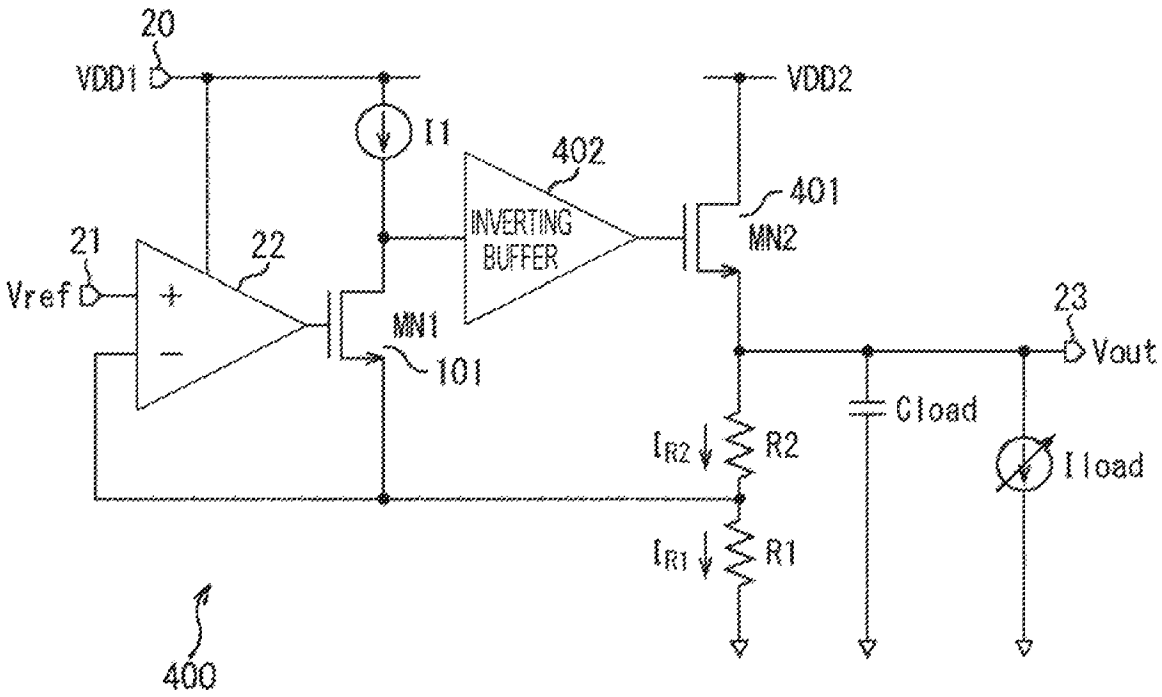
FIG. 9 is a view illustrating another configuration of one embodiment of the regulator to which the present technology is applied.

A fourth embodiment of a regulator circuit is described. FIG. 9 is a view illustrating a configuration of a regulator circuit 400 in the fourth embodiment.

The output transistor 102 in the first to third embodiments is the PMOS transistor, but this may also be formed of an NMOS transistor. An output transistor 401 of the regulator circuit 400 illustrated in FIG. 9 is the NMOS transistor and an inverting buffer 402 is connected to a gate of the output transistor 401.

An output terminal of the inverting buffer 402 is connected to the gate side of the output transistor 401 and an input terminal thereof is connected to a current source I1.

By forming the output transistor 401 of the NMOS transistor, it becomes possible to drive with voltage VDD2 smaller than voltage VDD1, and lower power consumption than in a case of forming the output transistor of the PMOS transistor may be realized.

Fifth Embodiment

Figure 10:
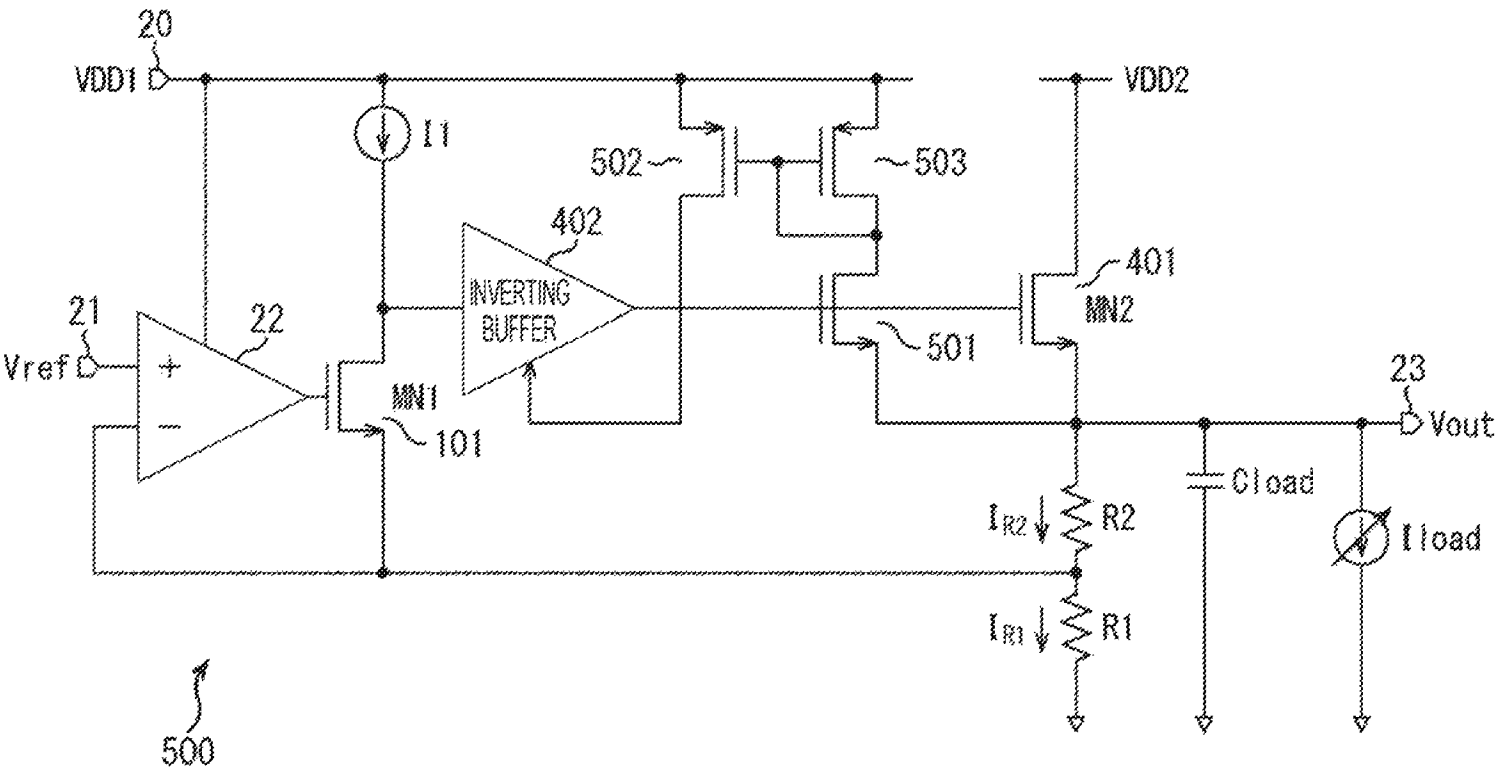
FIG. 10 is a view illustrating another configuration of one embodiment of the regulator to which the present technology is applied.

A fifth embodiment of a regulator circuit is described. FIG. 10 is a view illustrating a configuration of a regulator circuit 500 in the fifth embodiment.

The regulator circuit 500 illustrated in FIG. 10 has a configuration obtained by adding transistors 501 to 503 to the regulator circuit 400 illustrated in FIG. 9. The transistor 501 is an NMOS and the transistors 502 and 503 are formed of a PMOS. The transistors 502 and 503 form a current mirror circuit, and it is configured such that output current from the current mirror circuit is added to bias current of an inverting buffer 402.

Also, it is connected such that input current of the current mirror circuit is supplied from a drain side of the transistor 501. A gate of the transistor 501 is connected to an output terminal of the inverting buffer 402 and a source thereof is connected to an output terminal 23 of the regulator circuit 500.

In the configuration of the regulator circuit 500 illustrated in FIG. 10, like the regulator circuit 300 illustrated in FIG. 8, current proportional to load current is added to the bias current of the inverting buffer 402. By feeding back the current proportional to the load current, it is possible to configure such that a higher speed than that of the regulator circuit 400 illustrated in FIG. 9 may be realized.

Sixth Embodiment

Figure 11:
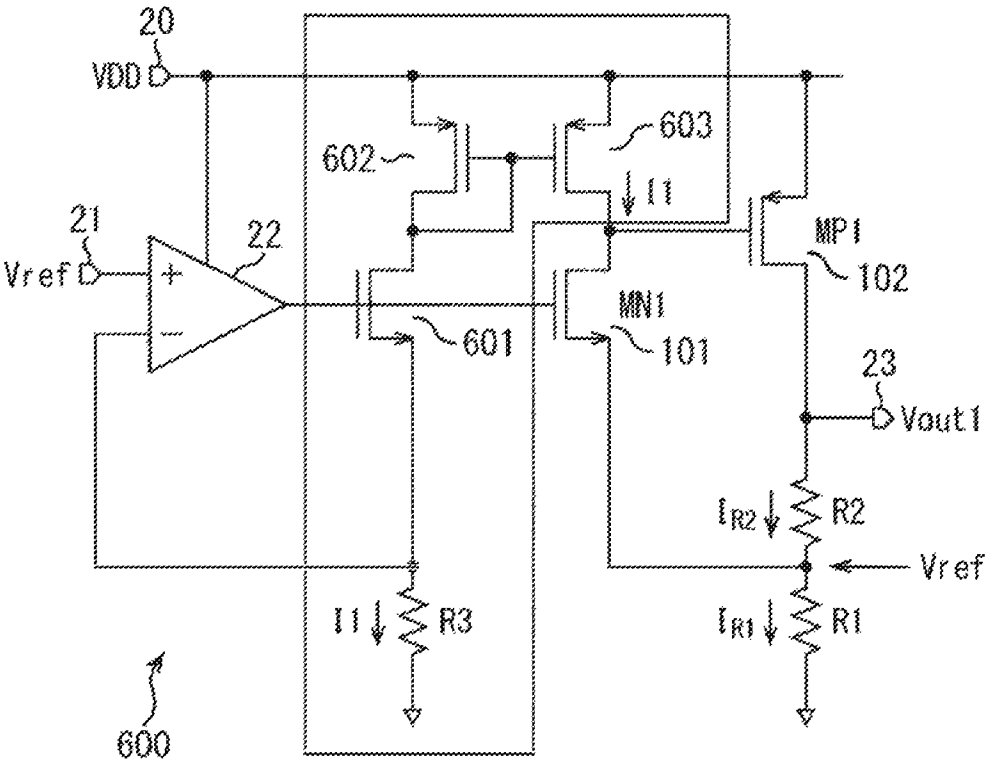
FIG. 11 is a view illustrating another configuration of one embodiment of the regulator to which the present technology is applied.

A sixth embodiment of a regulator circuit is described. FIG. 11 is a view illustrating a configuration of a regulator circuit 600 in the sixth embodiment.

The regulator circuit 600 illustrated in FIG. 11 has a configuration obtained by providing a replica circuit on the voltage feedback path 131 (FIG. 5) in the regulator circuit 100 (first embodiment) illustrated in FIG. 4. Even in a case where the replica circuit is provided, the voltage feedback path 131 is merely separated, so that basic operation is the same as that of the regulator circuit 100.

The regulator circuit 600 illustrated in FIG. 11 has a configuration obtained by adding transistors 601 to 603 forming the replica circuit and a resistor R3 to the regulator circuit 100 illustrated in FIG. 4.

The PMOS transistors 602 and 603 form a current mirror circuit, and it is connected such that output current from the current mirror circuit is input to a drain side of the NMOS transistor 101. The output current from the current mirror circuit is current I1 corresponding to the current I1 from the current source I1 in the regulator circuit 100 in FIG. 4.

Also, it is connected such that input current of transistor 602 forming the current mirror circuit is supplied from a drain side of the NMOS transistor 601. A gate of the transistor 601 is connected to an output terminal of a differential amplifier 22 and a source thereof is connected to an inverting input terminal of the differential amplifier 22 and is also connected to the resistor R3.

Figure 12:
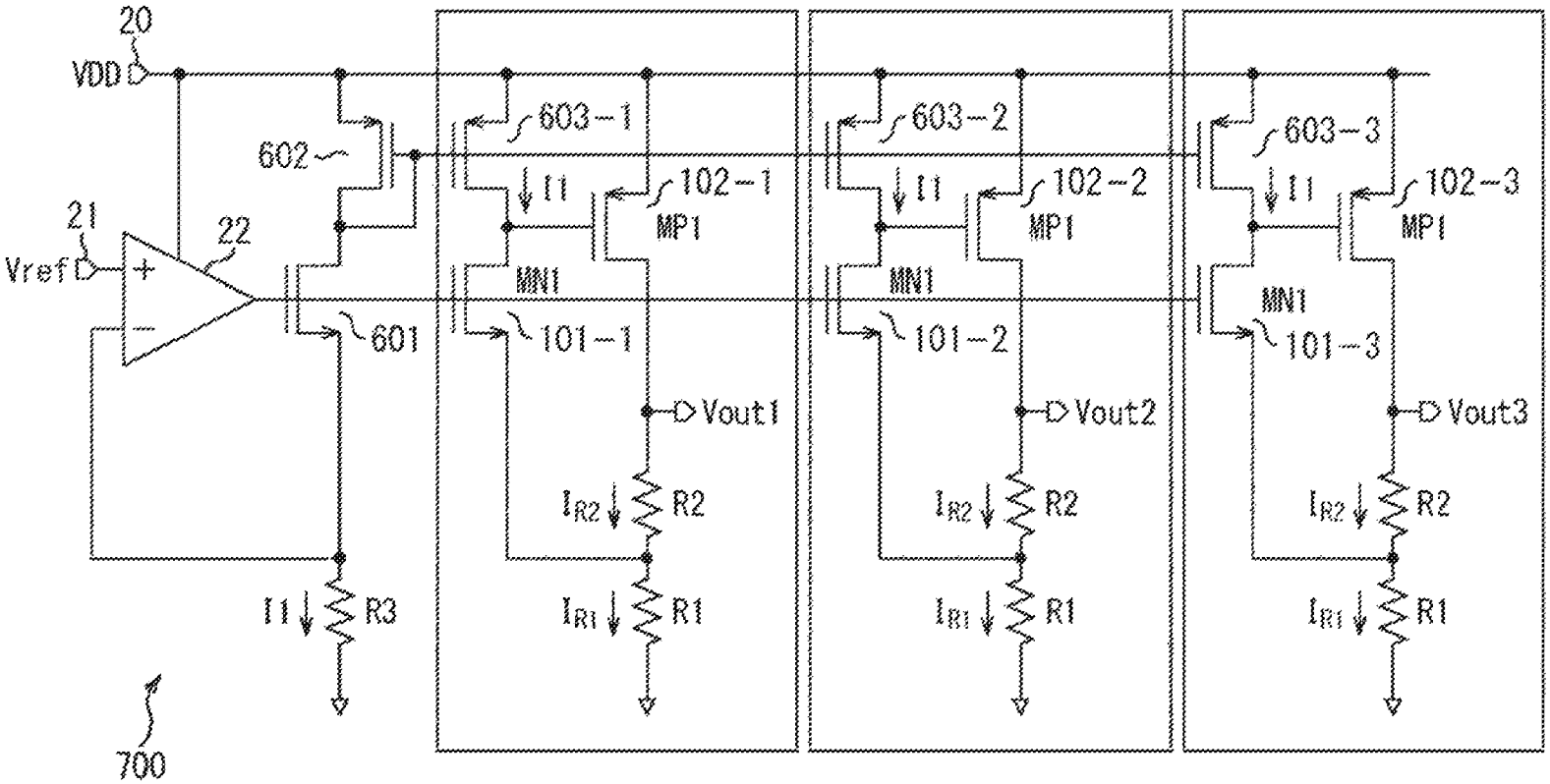
FIG. 12 is a view illustrating another configuration of one embodiment of the regulator to which the present technology is applied.

By including the current mirror circuit, the regulator circuit 600 may include multiple stages, and it may be configured such that one differential amplifier 22 includes a plurality of output stages. FIG. 12 illustrates a regulator circuit 700 including three output stages.

A first stage includes a transistor 603-1, a transistor 101-1, an output transistor 102-1, a resistor R1, and a resistor R2. The transistor 603-1 forms a current mirror circuit with the transistor 602, and the current I1 flows through the transistor 603-1. From the first stage, voltage Vout1 is taken out.

A second stage includes a transistor 603-2, a transistor 101-2, an output transistor 102-2, the resistor R1, and the resistor R2. The transistor 603-2 forms a current mirror circuit with the transistor 602, and the current I1 flows through the transistor 603-2. From the second stage, voltage Vout2 is taken out.

A third stage includes a transistor 603-3, a transistor 101-3, an output transistor 102-3, the resistor R1, and the resistor R2. The transistor 603-3 forms a current mirror circuit with the transistor 602, and the current I1 flows through the transistor 603-3. From the third stage, voltage Vout3 is taken out.

In this manner, it is possible to form a plurality of output stages by using one differential amplifier 22, thereby realizing low power consumption.

Meanwhile, it is possible to apply the regulator circuit 200 of the second embodiment illustrated in FIG. 7 to the regulator circuit 600 of the sixth embodiment illustrated in FIG. 11 to obtain a configuration with a buffer 201 added. Also, it is possible to apply the regulator circuit 300 of the third embodiment illustrated in FIG. 8 to the regulator circuit 600 of the sixth embodiment illustrated in FIG. 11 to obtain a configuration with the buffer 201 and a transistor 301 added.

Also, although a case where the output transistor 102 of the regulator circuit 600 of the sixth embodiment illustrated in FIG. 11 is a PMOS is described as an example, this may also be formed of an NMOS. In this case, it is possible to apply the configuration of the regulator circuit 400 of the fourth embodiment illustrated in FIG. 9 or the regulator circuit 500 of the fifth embodiment illustrated in FIG. 10 to the regulator circuit 600 of the sixth embodiment.

In this manner, according to the present technology, it becomes possible to realize a high-speed feedback path from a feedback resistor, realize a configuration in which a frequency characteristic does not depend on gain setting, and realize high speed and a frequency characteristic independent of the gain setting with a small occupied area without a complicated circuit configuration.

In this specification, the term "system" is intended to mean an entire device formed of a plurality of devices.

Meanwhile, the effect described in this specification is illustrative only; the effect is not limited thereto and there may also be another effect.

Meanwhile, the embodiments of the present technology are not limited to the above-described embodiments and various modifications may be made without departing from the scope of the present technology.

Meanwhile, the present technology may also have following configurations.

(1)

A regulator circuit including:

an output transistor provided between an input terminal and an output terminal;

a differential amplifying unit that amplifies a difference between reference voltage and voltage fed back from the output transistor;

a voltage feedback path; and a current feedback path, in which the current feedback path includes a current source and a transistor.

(2)

The regulator circuit according to (1) described above, in which a control terminal of the transistor included in the current feedback path is connected to an output terminal from the differential amplifying unit.

(3)

A regulator circuit according to (1) described above, in which the transistor included in the current feedback path is formed of an NMOS with a gate connected to an output terminal of the differential amplifying unit, a drain connected to the current source, and a source connected to an input terminal of the differential amplifying unit.

(4)

The regulator circuit according to any one of (1) to (3) described above, further including:

a buffer with an output terminal connected to a control terminal of the output transistor.

(5)

The regulator circuit according to any one of (1) to (3) described above, further including:

a buffer with an output terminal connected to a control terminal of the output transistor; and a transistor for feeding back current proportional to load current to bias current of the buffer.

(6)

The regulator circuit according to any one of (1) to (5) described above, in which the output transistor is an NMOS.

(7)

The regulator circuit according to (6) described above, further including:

an inverting buffer with an output terminal connected to a control terminal of the output transistor.

(8)

The regulator circuit according to (6) described above, further including:

an inverting buffer with an output terminal connected to a control terminal of the output transistor; and a transistor for feeding back current proportional to load current to bias current of the inverting buffer.

(9)

The regulator circuit according to any one of (1) to (8) described above, further including:

a replica circuit on the voltage feedback path.

(10)

The regulator circuit according to (9) described above, in which the replica circuit includes first to third transistors, a control terminal of the first transistor is connected to an output terminal of the differential amplifying unit, and the second transistor and the third transistor serve as the current source.

(11)

The regulator circuit according to (1) described above, in which a plurality of output stages is provided for one differential amplifying unit, and each of the output stages includes a current feedback path, an output transistor, and a feedback resistor.

(12)

A control method of a regulator circuit provided with:

an output transistor provided between an input terminal and an output terminal; and a differential amplifying unit that amplifies a difference between reference voltage and voltage fed back from the output transistor, the control method including steps of:

controlling voltage feedback by a voltage feedback path; and controlling current feedback by a current feedback path, in which the current feedback is performed by controlling a current source and a transistor included in the current feedback path.

REFERENCE SIGNS LIST

20 Differential amplifier
100 Regulator circuit
101 Transistor
102 Output transistor
200 Regulator circuit
201 Buffer
300 Regulator circuit
301 Transistor
400 Regulator circuit
401 Output transistor
402 Inverting buffer
500 Regulator circuit
501 to 503 Transistor
600 Regulator circuit
601 to 603 Transistor

The invention claimed is:

1. A regulator circuit, comprising:
an output transistor between an input terminal and an output terminal;
a feedback resistor connected to the output transistor;
a differential amplifying unit configured to amplify a difference between a reference voltage and a feedback voltage generated by the feedback resistor;
a voltage feedback path configured to connect the feedback voltage to the differential amplifying unit; and
a current feedback path that includes a current source and a first transistor, wherein
the current feedback path is configured to connect the feedback voltage to the first transistor of the current feedback path,
a gate of the first transistor is connected to an output terminal of the differential amplifying unit,
a source of the first transistor is connected to an inverting input terminal of the differential amplifying unit,
a drain of the first transistor is connected to the current source, and
the current source is connected to an input voltage from the input terminal.

2. The regulator circuit according to claim 1, wherein the first transistor is an N-Type Metal-Oxide-Semiconductor (NMOS) transistor.

3. The regulator circuit according to claim 1, further comprising a buffer, wherein an output terminal of the buffer is connected to a control terminal of the output transistor.

4. The regulator circuit according to claim 1, further comprising:
a buffer, wherein an output terminal of the buffer is connected to a control terminal of the output transistor; and
a second transistor configured to feedback a current to bias current of the buffer, wherein the feedback current is proportional to a load current of the regulator circuit.

5. The regulator circuit according to claim 1, wherein the output transistor is an N-Type Metal-Oxide-Semiconductor (NMOS) transistor.

6. The regulator circuit according to claim 5, further comprising an inverting buffer, wherein an output terminal of the inverting buffer is connected to a control terminal of the output transistor.

7. The regulator circuit according to claim 5, further comprising:
an inverting buffer, wherein an output terminal of the inverting buffer is connected to a control terminal of the output transistor; and
a second transistor configured to feedback a current to bias current of the inverting buffer, wherein the feedback current is proportional to a load current of the regulator circuit.

8. The regulator circuit according to claim 1, further comprising a replica circuit on the voltage feedback path.

9. The regulator circuit according to claim 8, wherein
the replica circuit includes a plurality of second transistors,
a control terminal of a first transistor of the plurality of second transistors is connected to the output terminal of the differential amplifying unit, and
a second transistor of the plurality of second transistors and a third transistor of the plurality of second transistors serve as the current source.

10. The regulator circuit according to claim 1, wherein
the differential amplifying unit includes a plurality of output stages, and
each output stage of the plurality of output stages includes at least one of the current feedback path, the output transistor, or the feedback resistor.

11. A control method, comprising:
in a regulator circuit including an output transistor between an input terminal and an output terminal, a feedback resistor connected to the output transistor, and a differential amplifying unit configured to amplify a difference between a reference voltage and a feedback voltage generated by the feedback resistor:
connecting the feedback voltage to the differential amplifying unit by a voltage feedback path of the regulator circuit; and
connecting the feedback voltage to a transistor in a current feedback path of the regulator circuit, wherein
a current fed back by the current feedback path is controlled based on a current source and the transistor in the current feedback path,
a gate of the transistor is connected to an output terminal of the differential amplifying unit,
a source of the transistor is connected to an inverting input terminal of the differential amplifying unit,
a drain of the transistor is connected to the current source, and
the current source is connected to an input voltage from the input terminal.

* * * * *